US008291836B2

(12) United States Patent
Jian et al.

(10) Patent No.: US 8,291,836 B2
(45) Date of Patent: Oct. 23, 2012

(54) PAPER PALLET STRUCTURE

(75) Inventors: Bo-Xin Jian, New Taipei (TW); Yaw-Shin Liao, New Taipei (TW); Kao-Hsiung Liao, New Taipei (TW)

(73) Assignees: Air-Bag Packing Co., Ltd., New Taipei (TW); Yaw-Shin Liao, New Taipei (TW)

( * ) Notice: Subject to any disclaimer, the term of this patent is extended or adjusted under 35 U.S.C. 154(b) by 0 days.

(21) Appl. No.: 13/243,000

(22) Filed: Sep. 23, 2011

(65) Prior Publication Data

US 2012/0204767 A1 Aug. 16, 2012

(30) Foreign Application Priority Data

Feb. 16, 2011 (TW) ..... 100105120

(51) Int. Cl.
*B65D 19/00* (2006.01)

(52) U.S. Cl. ..... 108/51.3

(58) Field of Classification Search ..... 108/51.3, 108/51.11, 56.3; 248/346.02
See application file for complete search history.

(56) References Cited

U.S. PATENT DOCUMENTS

| | | | | |
|---|---|---|---|---|
| 2,702,682 | A * | 2/1955 | Newsom | 108/51.3 |
| 3,273,518 | A * | 9/1966 | Shina | 108/51.3 |
| 4,391,202 | A * | 7/1983 | Carter et al. | 108/51.3 |
| 5,184,558 | A * | 2/1993 | Wozniacki | 108/51.3 |
| 5,207,631 | A * | 5/1993 | Schmidtke et al. | 108/51.3 |
| 5,337,679 | A * | 8/1994 | Moorman | 108/51.3 |
| 5,357,875 | A * | 10/1994 | Winebarger et al. | 108/51.3 |
| 5,461,988 | A * | 10/1995 | Cummings et al. | 108/51.3 |
| 7,013,814 | B2 * | 3/2006 | Modesitt et al. | 108/51.3 |
| 7,475,639 | B2 * | 1/2009 | Chen | 108/51.3 |
| 8,113,129 | B1 * | 2/2012 | Hurley et al. | 108/51.3 |
| 2008/0295747 | A1 * | 12/2008 | Vinderola | 108/51.3 |
| 2009/0188411 | A1 * | 7/2009 | Gibson et al. | 108/51.3 |

FOREIGN PATENT DOCUMENTS

GB 2270298 A * 3/1994

* cited by examiner

*Primary Examiner* — Jose V Chen
(74) *Attorney, Agent, or Firm* — Muncy, Geissler, Olds & Lowe, PLLC

(57) ABSTRACT

A paper pallet structure, includes a plurality of first sheet bodies and a plurality of second sheet bodies, the first sheet body is bent to form two wing portions, a first connecting portion connected to the two wing portions, and a first supporting portion positioned between the two first wing portions and coming into abutting contact with the first connecting portion, and the second sheet body is bent to form two wing portions, a second connecting portion connected to the two wing portions, and a second supporting portion positioned between the two second wing portions and coming into abutting contact with the second connecting portion. The first wing portion and the second wing portion respectively have first engagement portions and second engagement portions, and the first engagement portions are engaged with the second engagement portions to position the first sheet body and the second sheet body perpendicular to each other.

10 Claims, 15 Drawing Sheets

PAPER PALLET STRUCTURE

CROSS-REFERENCES TO RELATED APPLICATIONS

This non-provisional application claims priority under 35 U.S.C.§119(a) on Patent Application No(s). 100105120 filed in Taiwan, R.O.C. on Feb. 16, 2011, the entire contents of which are hereby incorporated by reference.

BACKGROUND

1. Technical Field

The present invention relates to a pallet structure, and more particularly to a paper pallet structure.

2. Related Art

Pallets are very common auxiliary tools in cargo transportation. A conventional pallet is formed by combining a plurality of interlaced wood strips together, the top of which is a mounting face for the placement of goods, and there are foot pieces below the mounting face to elevate the mounting face for preventing stored goods, which are too close to the ground, from being damped, and allowing the forks of a fork lift to reach into the bottom of the pallet directly to lift each whole pallet and stack them at a proper position directly and conveniently during transport; for example, stacking them in a storage area of a warehouse after removing them from a cargo container.

However, the weight of a conventional wood-made pallet is considerable; it is labor-consuming during transport, such that pallets are now available on the market made from many other materials other than wood, such as plastics or light metal. Recently however, owing to environmental demands, paper pallets have appeared in the market; paper pallets are made mainly from recycled paper; they are lighter, can be recycled, and conform to environmental demands. Furthermore, their production costs are lower in comparison with pallets made from other materials However, general paper pallets must be made individually by hand; their lifespan is shorter and their strength is lower, leading to a limited mounting weight. As a result, paper pallets generally have a rather complex structure incapable of continuous manufacturing and mass production while maintaining a certain degree of quality, such that paper pallet designs with a simple structure and a good bearing capacity seldom appear in the market.

SUMMARY

To develop a paper pallet with good load bearing capacity and a simple structure, capable of mass production on machines and low in cost, quality control, the present invention is proposed.

The present invention proposes a paper pallet including a plurality of first sheet bodies and a plurality of second sheet bodies, where each first sheet body has two first outer plate bodies, a first connecting portion and a first inner plate body, where each first outer plate body includes a plurality of first slots and a plurality of first fold-lines perpendicularly intersected to each other, the first connecting portion is positioned between the two first outer plate bodies and coupled thereto, and the first inner plate body is coupled to one of the two first outer plate bodies. The first inner plate body is folded toward the first outer plate body to form a first supporting portion, the two first outer plate bodies are bended along the first fold-lines to form two first wing portions, the two first slots are formed into two engagement portions, and the first supporting portion is positioned between the two first wing portions and comes into abutting contact with the first connecting portion. Furthermore, the aforementioned second sheet body has two second outer plate body, a second connecting portion and a second inner plate body, where each second outer plate body includes a plurality of second slots and a plurality of second fold-lines perpendicularly intersected to each other, the second connecting portion is positioned between the two second outer plate bodies and coupled to the two second outer plate bodies, and the second inner plate body is coupled to one of the two second outer plate bodies. The second inner plate body is bent toward the second outer plate body to form a second supporting portion, the two second outer plate bodies are bended along the second fold-lines to form two second wing portions, the two second slots are formed into two second engagement portions, and the second supporting portion is positioned between the two second wing portions and comes into abutting contact with the second connecting portion, and the first engagement portions and the second engagement portions are engaged with each other to position the first sheet bodies and the second sheet bodies perpendicular to each other. However, an angle between the first sheet body and the second sheet body may be approximately 90 degrees though not exactly 90 degrees depending on a practical design and process while putting into practice. The perpendicular intersection means that the slot and the fold-line are intersected with each other by an included angle of 90 degrees. However, an angle between the slot and the fold-line. may be approximately 90 degrees though not exactly 90 degrees depending on a practical design and process while putting into practice; the perpendicularity as mentioned previously may include an almost right angle depending on a practical design and process.

The paper pallet structure is respectively manufactured in X-axis and Y-axis directions, and assembled while in use after the manufacturing is completed; it is not only structured simply but has a good bearing capacity. In addition, the present invention is only constituted by the plurality of first sheet bodies and the plurality of second sheet bodies, where the first sheet body and the second sheet body are respectively overlaid to be a pallet by means of adhesion. The production cost and the assembly time can be reduced due to the simplicity of the structure, meaning it can be produced continuously with machines, and is convenient for assembly while being used. Furthermore, the first sheet body and the second sheet body mentioned previously are respectively folded to form the first supporting portion and the second supporting portion, and combination faces are covered with glue during the folding to allow the inside thereof to be combined tightly; this inherently increases the hardness of the paper plate. The first supporting portion and the second supporting portion mentioned previously both have a substantial thickness such that the paper pallet structure can be strengthened, and are both waterproof and moisture-proof. Furthermore, use of the paper pallet structure can be increased effectively when they are combined with each other by means of intersection.

BRIEF DESCRIPTION OF THE DRAWINGS

The present invention can be more fully understood by reference to the following description and accompanying drawings, in which.

DETAILED DESCRIPTION

Figure 1:
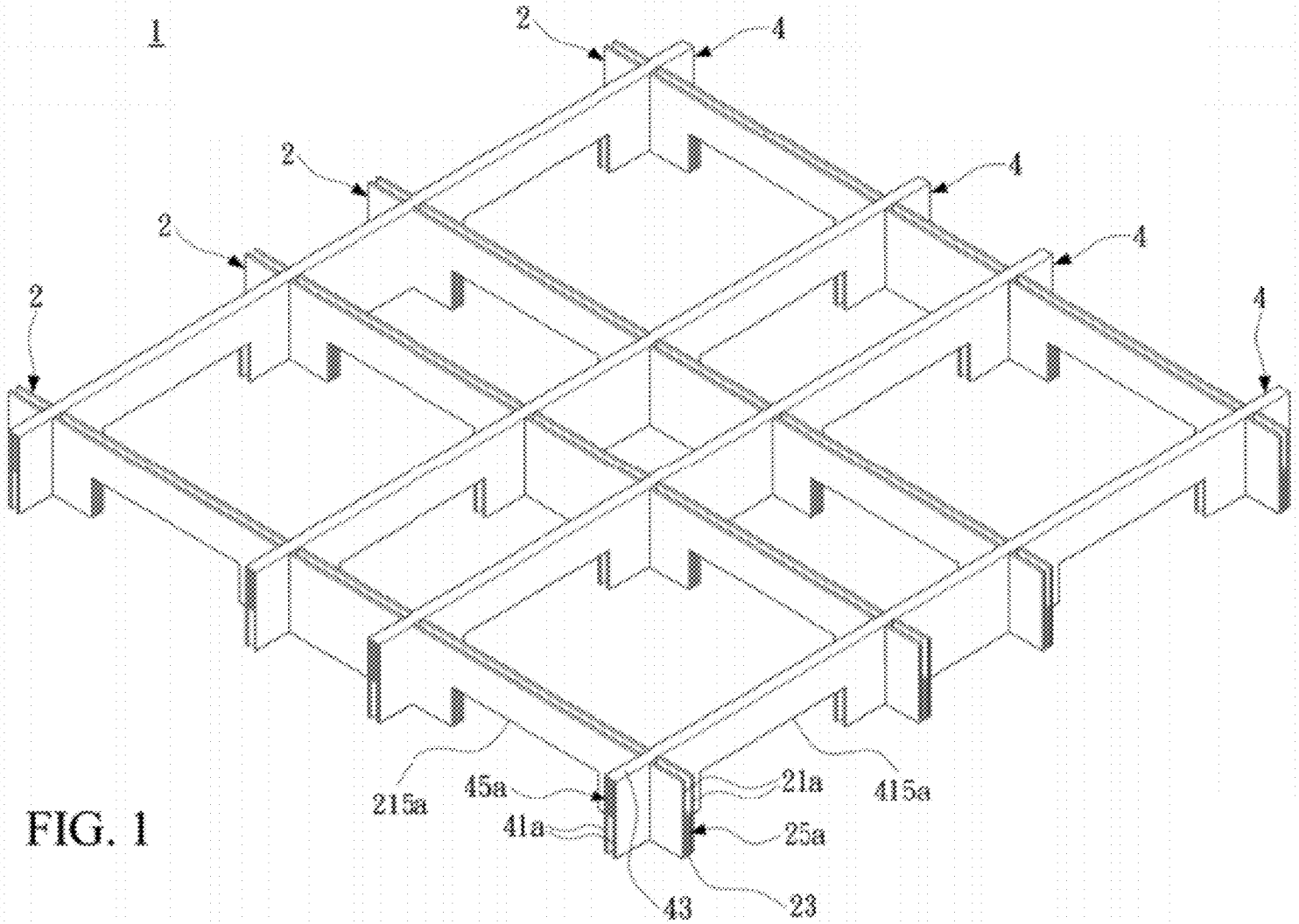
FIG. 1 is a schematically perspective view of a paper pallet structure of a first preferred embodiment according to the present invention.
Figure 2A:
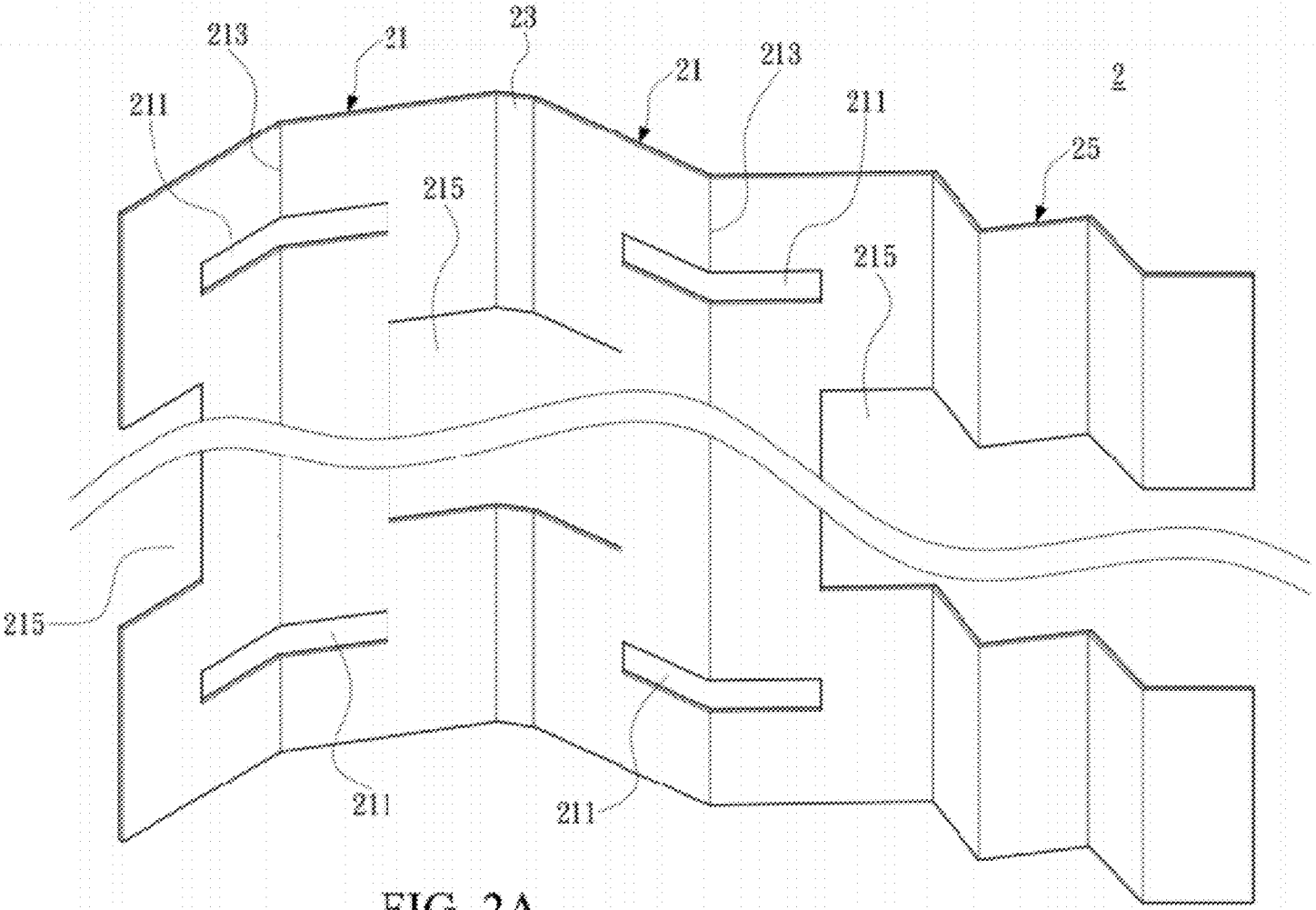
FIGS. 2A to 2D are schematically perspective views of a first sheet body disclosed by the first embodiment according to the present invention.
Figure 2B:
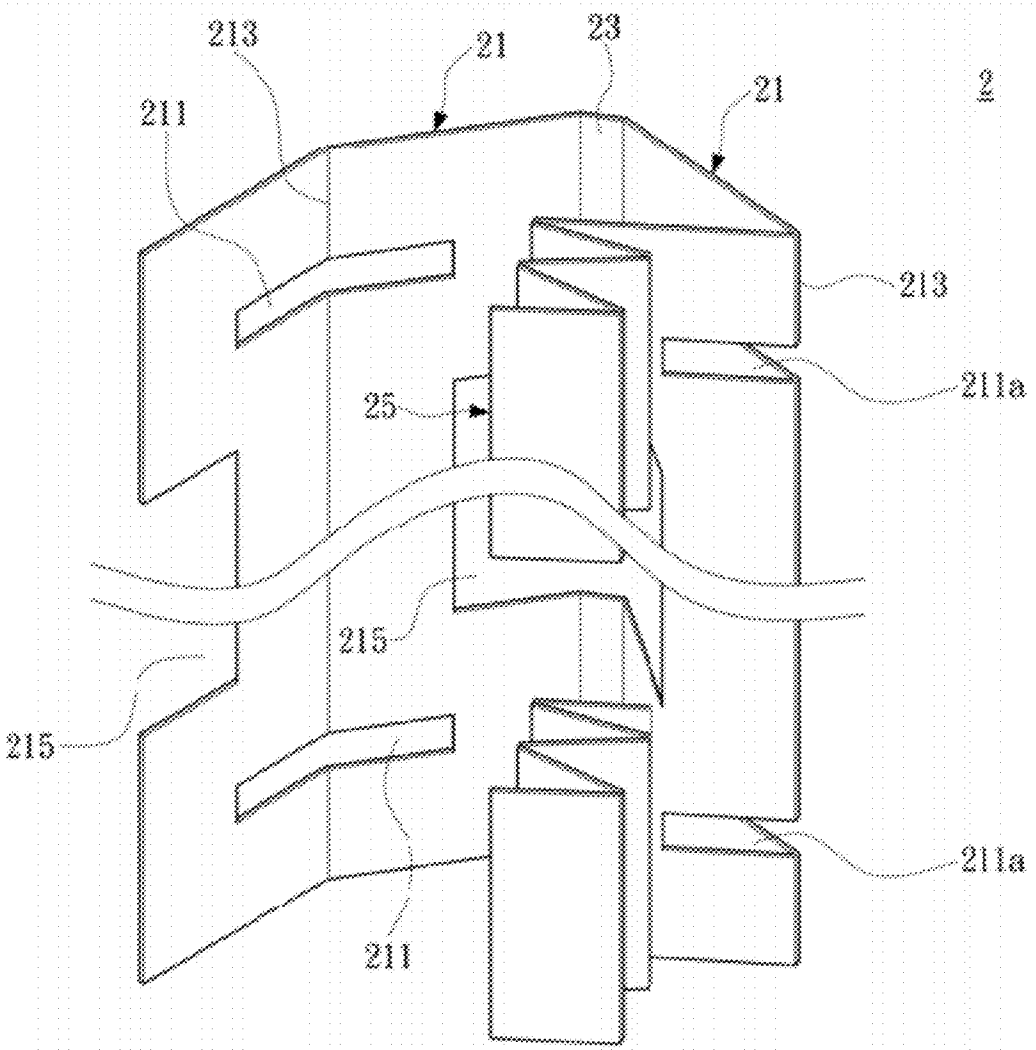
Figure 2C:
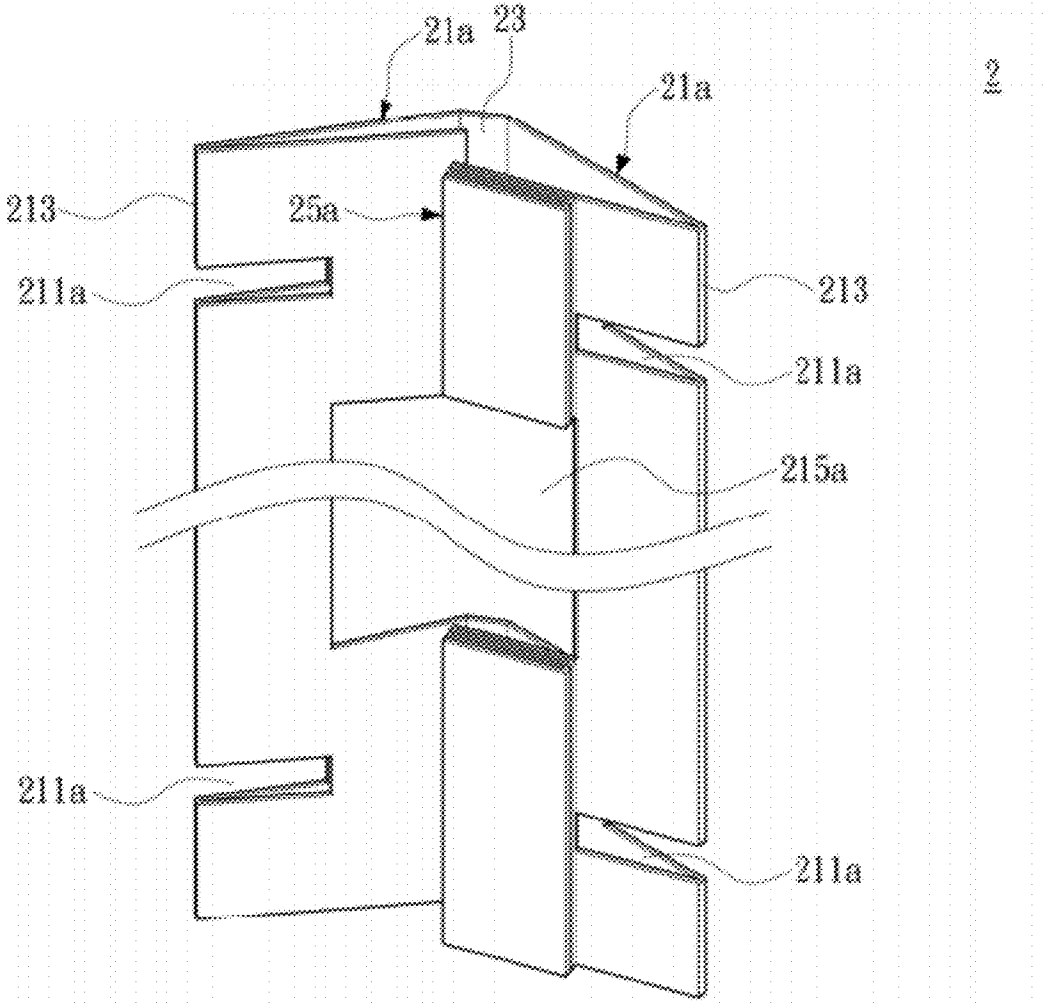
Figure 2D:
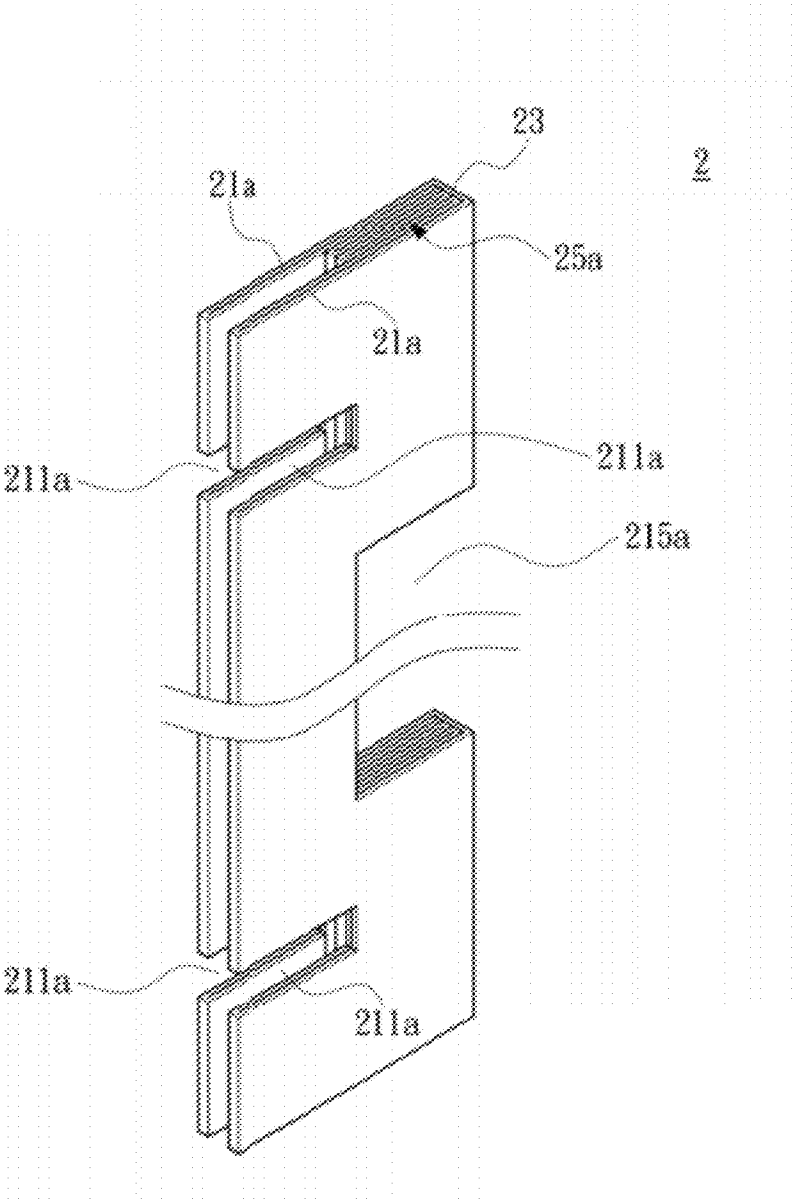
Figure 3A:
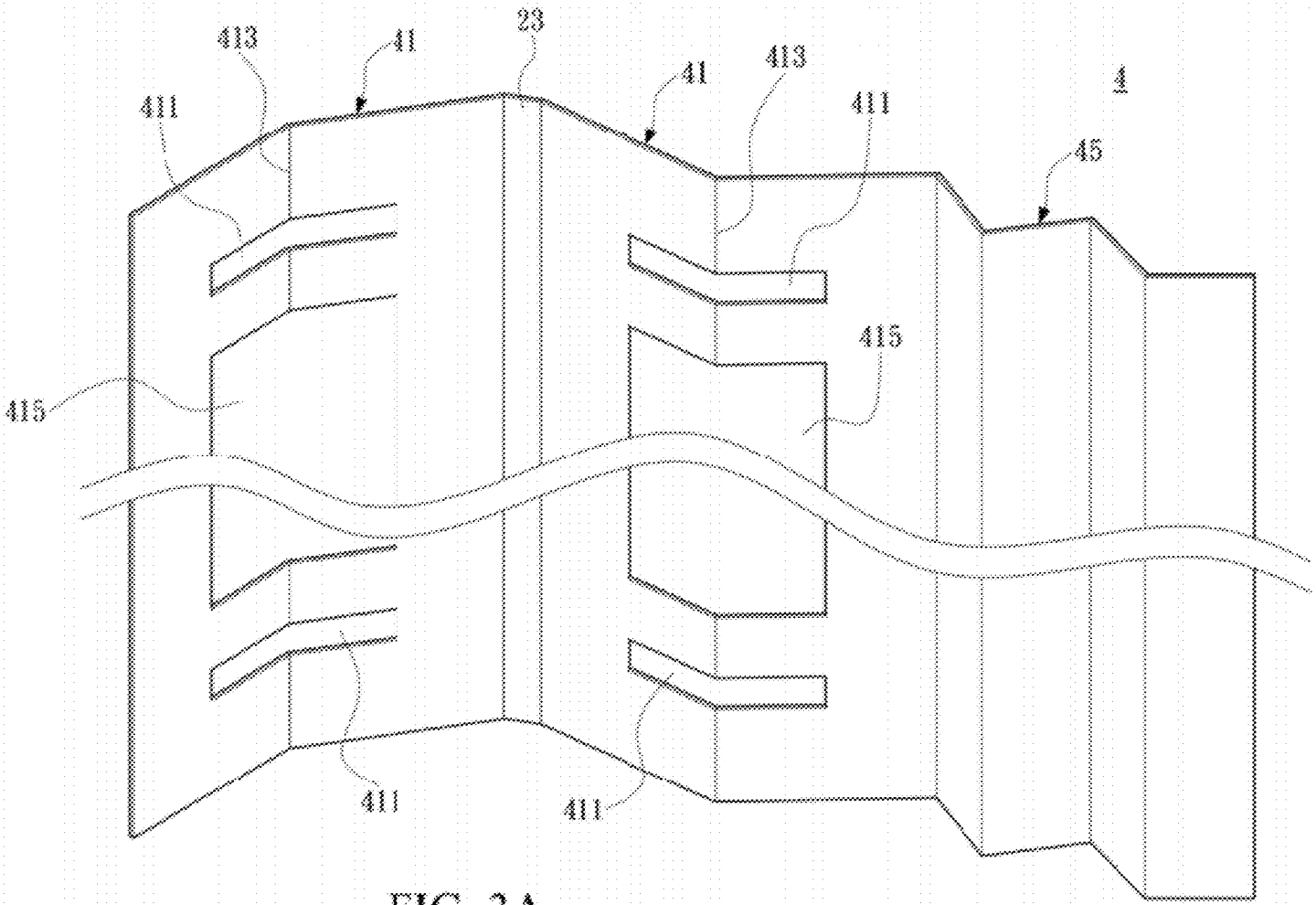
FIGS. 3A to 3D are schematically perspective views of a second sheet body disclosed by the first embodiment according to the present invention.
Figure 3B:
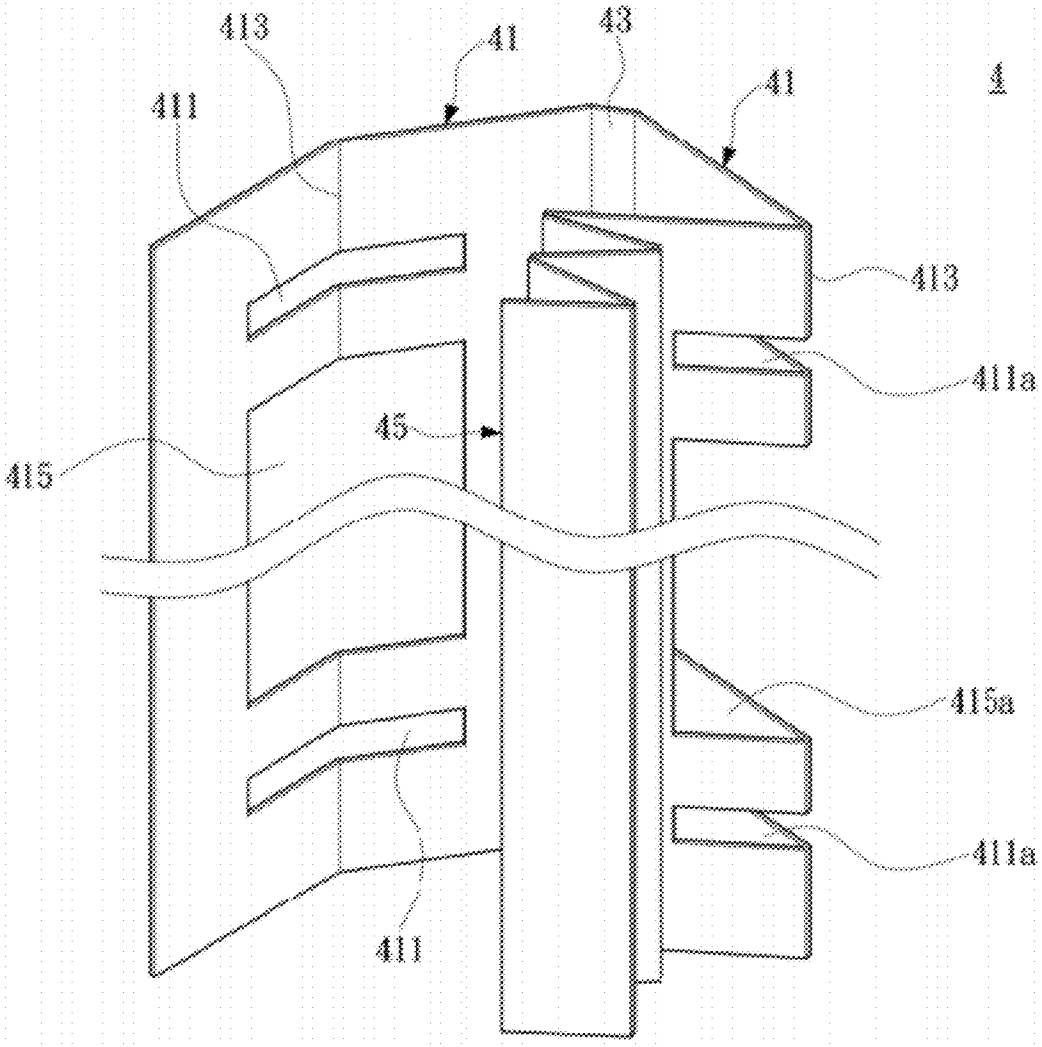
Figure 3C:
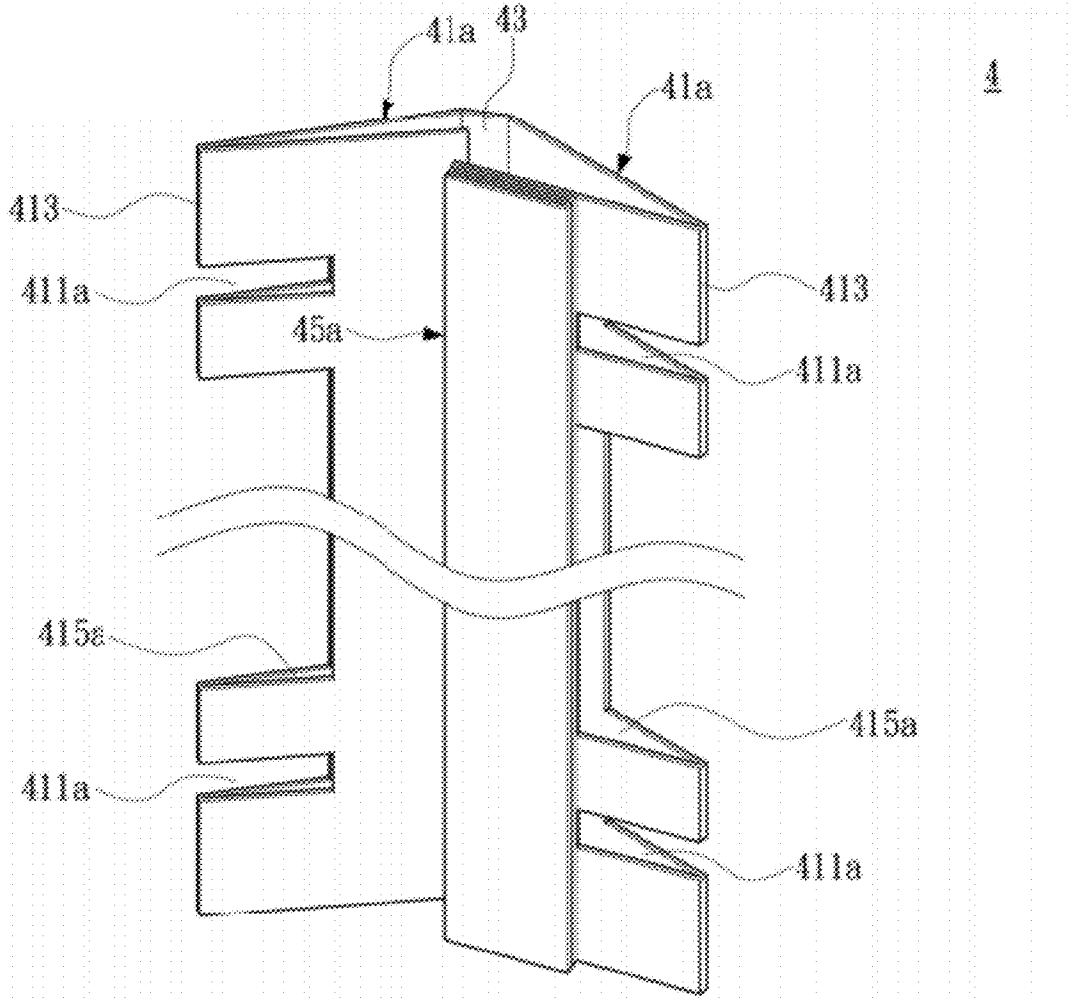
Figure 3D:
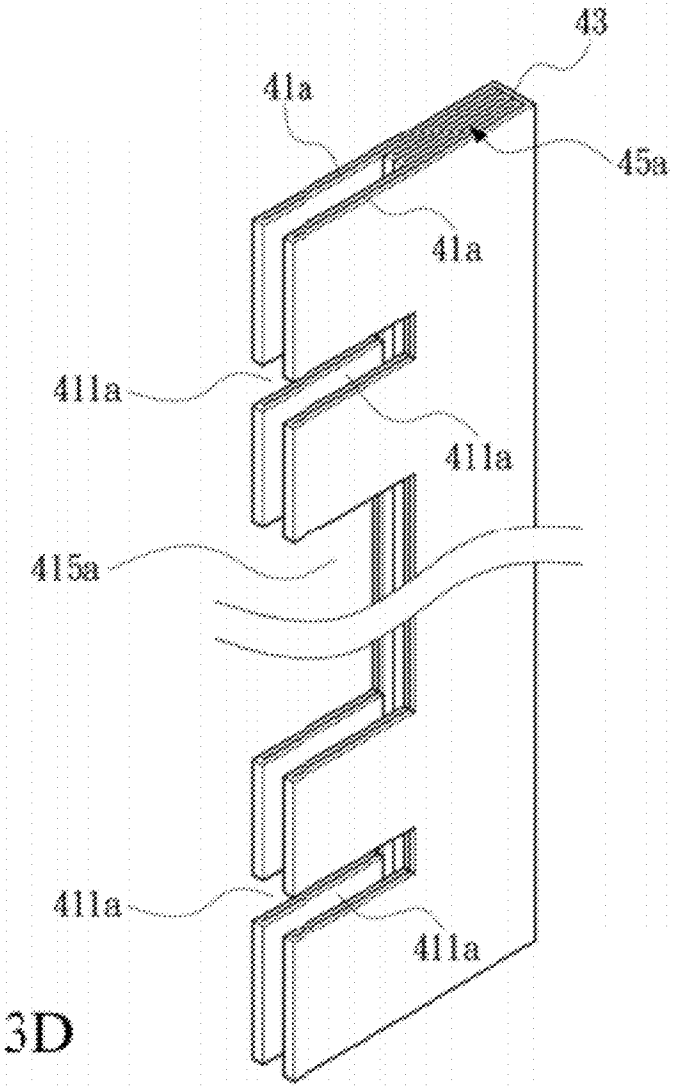
Figure 4A:
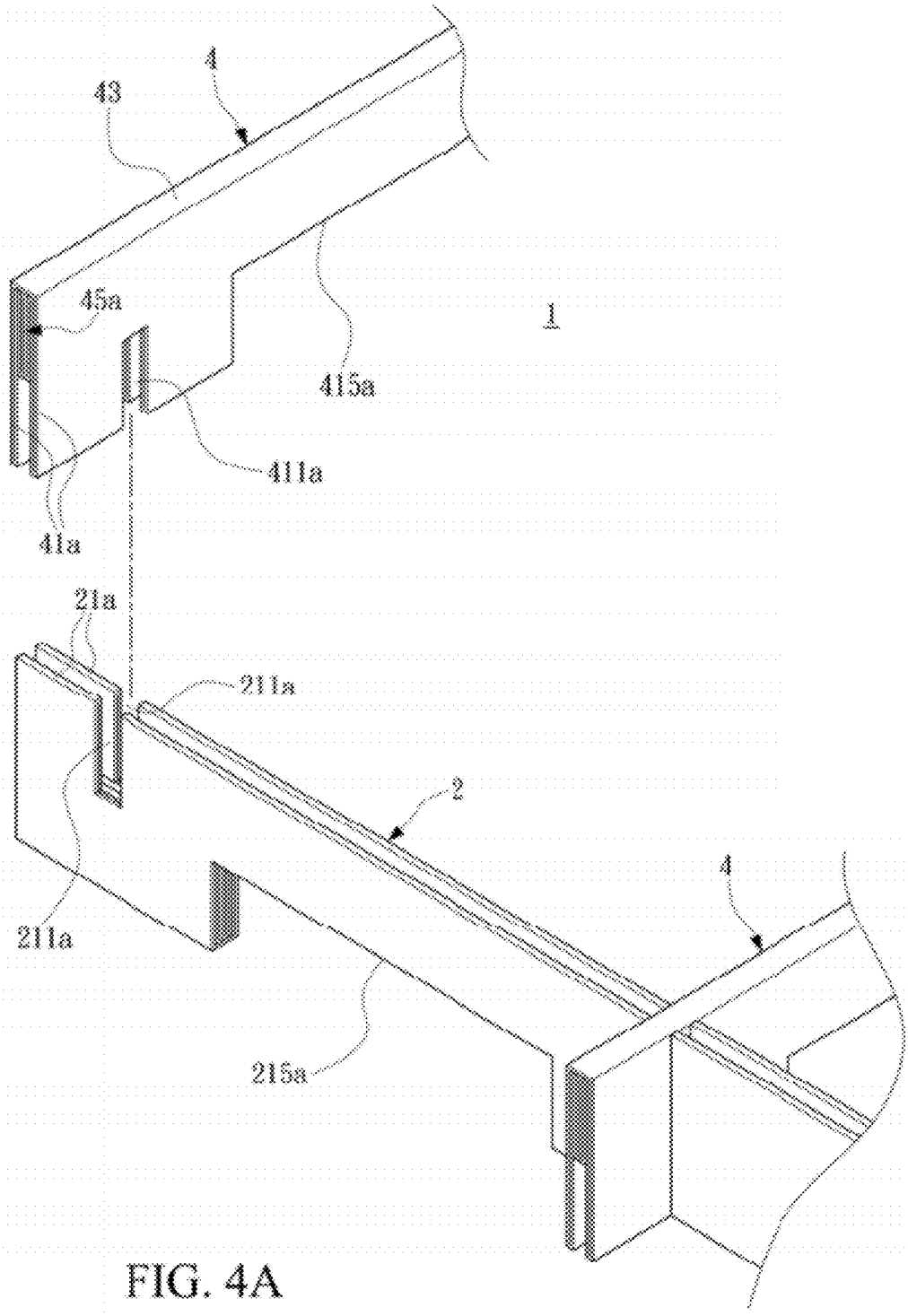
FIGS. 4A and 4B are exploded views of a paper pallet structure disclosed by the first embodiment according to the present invention.
Figure 4B:
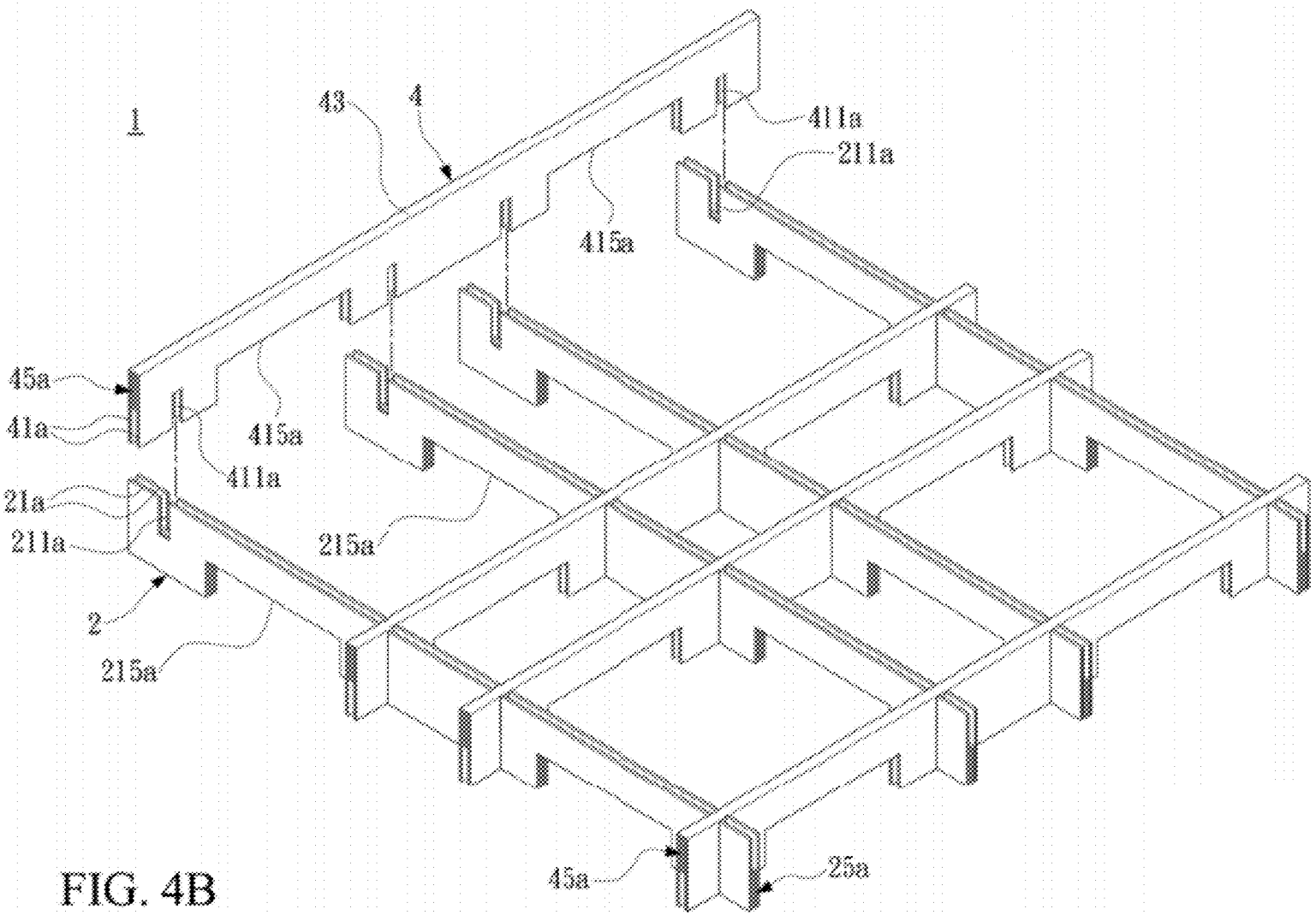

Please refer to FIG. 1, in which a paper pallet structure of a first preferred embodiment according to the present invention mainly includes a plurality of first sheet bodies 2 and a plurality of second sheet bodies 4, where the first sheet body 2 and the second sheet body are perpendicular to each other. The material of the first sheet body 2 and the second sheet body 4 may be corrugated paper, craft paper, recycled paper or the like. However, the aforementioned materials are only examples, the present invention is not limited to these.

Please refer to FIGS. 2A to 2D, in which the first sheet body 2 is mainly constituted by two first outer plate bodies 21, a first connecting portion 23 and a first inner plate body 25.

The first outer plate body 21 is disposed with a plurality of first slots 211 and a plurality of first fold-lines 213 on the center thereof, where the shape of the first slot 211 is a rectangle. The long side of the rectangle is intersected perpendicularly with the first fold-line 213.

The first connecting portion 23 is positioned between the two first outer plate bodies 21, being connected to the two first outer plate bodies 21.

The first inner plate body 25 is connected to one of the two first outer plate bodies 21.

A first supporting portion 25*a* will be formed after the first inner plate body 25 is bent and folded toward the first outer plate body 21, two first wing portions 21*a* will be formed after the two first outer plate bodies 21 are bent respectively along the first fold-line 213, and the first slot 211 of the first outer plate body 21 is then formed into a U-typed notch of first engagement portion 211*a*, where the first supporting portion 25*a* is positioned between the two first wing portions 21*a* and comes into abutting contact with the first connecting portion 23.

Please refer to FIGS. 3A to 3D, in which the second sheet body 4 is constituted by two second outer plate bodies 411, a second connecting portion 43 and a second inner plate body 45.

The second outer plate body 41 is disposed with a plurality of second slots 411 and a plurality of second fold-lines 413 on the center thereof, where the shape of the second slot 411 is a rectangle. The long side of the rectangle is intersected perpendicularly with the second fold-line 413.

The second connecting portion 43 is positioned between the two second outer plate bodies 41, being connected to the two first outer plate bodies 41.

The second inner plate body 45 is connected to one of the two second outer plate bodies 41.

A second supporting portion 45*a* will be formed after the second inner plate body 45 is bent and folded toward the second outer plate body 41, two second wing portions 41*a* will be formed after the two second outer plate bodies 41 are bent respectively along the second fold-line 413, and each second slot 411 of the second outer plate body 41 is then formed into a U-typed notch of second engagement portion 411*a*, where the second supporting portion 45*a* is positioned between the two second wing portions 41*a* and comes into abutting contact with the second connecting portion 43. In this way, each first engagement portion 211*a* is engaged with the corresponding second engagement portion 411*a* to position the first sheet body 2 perpendicular to the second sheet body 4 so as to form a lattice-typed paper pallet structure.

Furthermore, the second sheet body 4 further includes a plurality of second through holes 415 adjacent to the second slots 411. The shape of the second through hole 415 is rectangular, where the length of the shorter side of the second through hole 415 is equal to the length of the longer side of the second slot 411, and the shorter side of the second through hole 415 is perpendicular to the second fold-line 413. The second through hole 415 will be formed into a second retaining groove 415*a* after the second outer plate bodies 41 are bent respectively along the second fold-lines 413. The second retaining grooves allow forks of a fork lift to be inserted in to lift and move the paper pallet. In addition, in the present embodiment, the first sheet body 2 may also have a plurality of first through holes (not shown in the figures), used for forming a plurality of first retaining grooves, which allows forks of a fork lift to be inserted in.

In the description mentioned previously, the first sheet body 2 and the second sheet body 4 respectively are a single plate body. However, such a single plate body is only exemplary and explanatory; the present invention is not limited to this, and the first sheet body 2 and the sheet body 4 may be formed by sticking a plurality of small plate bodies together with glue after being folded.

Figure 5A:
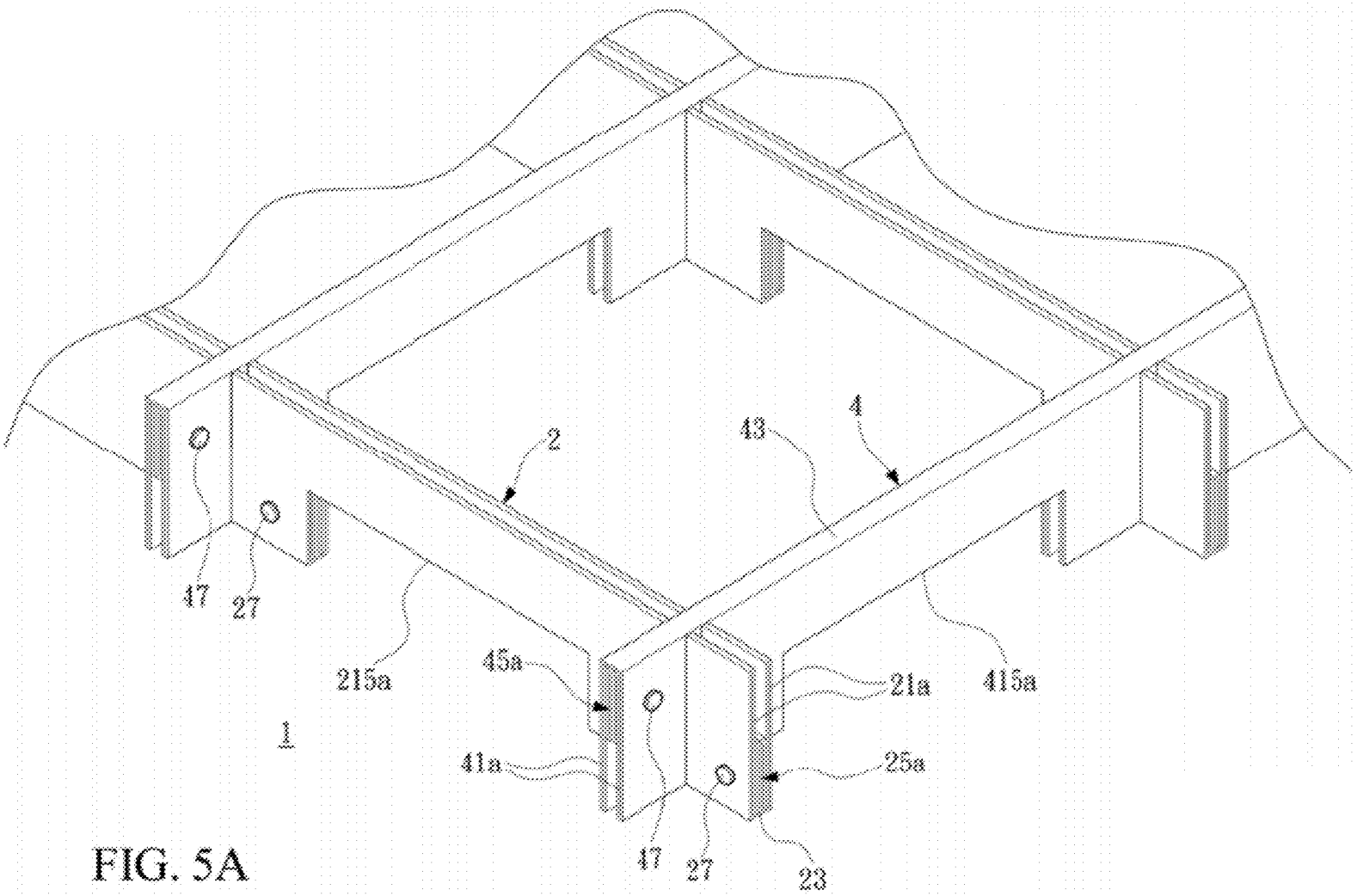
FIG. 5A is a partly perspective view of a paper structure with locking elements of the first embodiment according to the present invention.
Figure 5B:
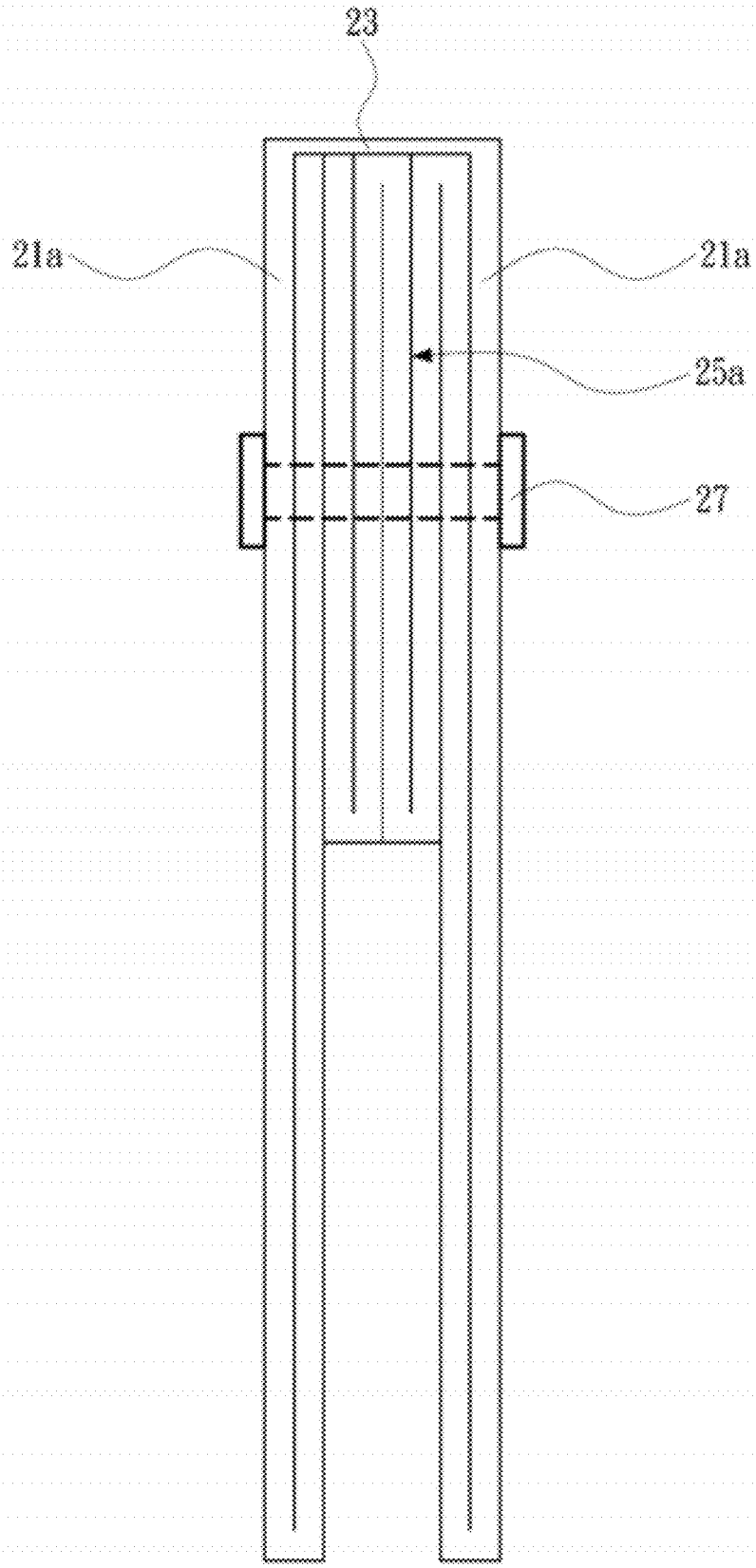
FIG. 5B is a schematic view of a first sheet body of the first embodiment according to the present invention, where the coupling of a first supporting portion to first wing portions with a locking element is shown.

In addition, a plurality of first locking elements 27 may be used to couple the first wing portions 21*a* to the first supporting portion 25*a*, and a plurality of second locking elements 47 may be used to couple the second wing portions 41*a* to the second supporting portion 45*a* in the present embodiment as FIG. 5A shows. The first locking element 27 and the second locking element 47 may respectively be a plastic or metal rivet, mushroom pin, staple, or the like as FIG. 5B shows. However, these are exemplary and explanatory only, the present invention is not limited to these. In addition, the first wing portion 21*a* may be couple to the first supporting portion 25*a*, and the second wing portion 41*a* may be coupled to the second supporting portion 45*a* by means of glue, which may be a resin, hot melt adhesive, cold melt adhesive, or the like. However, these are exemplary and explanatory only, the present invention is not limited to these.

Figure 6A:
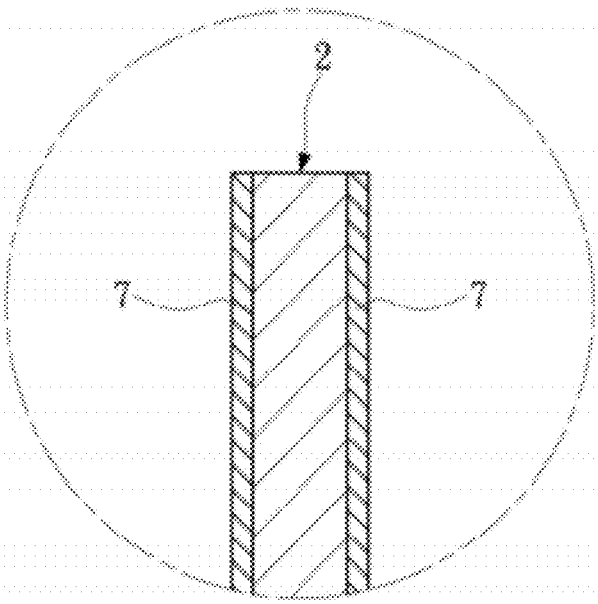
FIG. 6A is a schematic view of an exemplary structure with a protection layer of the first embodiment according to the present invention.

On the other hand, the surfaces of the first sheet body 2 and the second sheet body 4 can be spread with a water repellent protection layer 7 as FIG. 6A shows, for example, a waterproof material, used for preventing the paper pallet from becoming waterlogged and therefore softened. The protection layer 7 may be a water repellent and hydrophobic wax membrane or other water repellent agents. However, these are exemplary and explanatory only, the present invention is not limited to these.

Figure 6B:
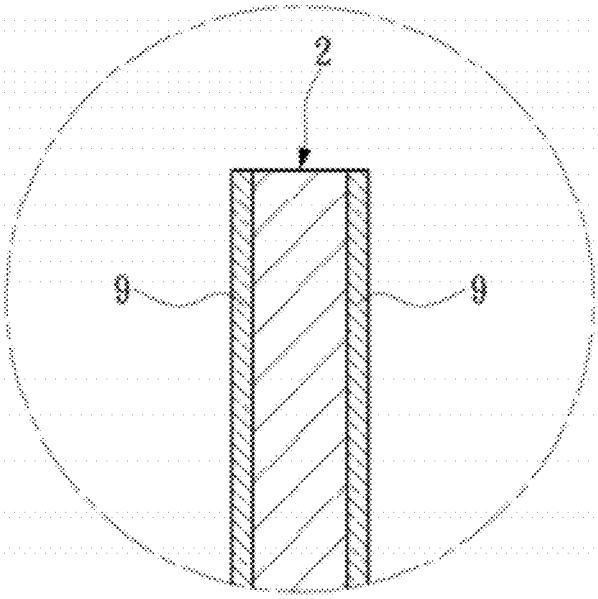
FIG. 6B is a schematic view of an exemplary structure with a strengthening layer of the first embodiment according to the present invention.

In addition, the surfaces of the first sheet body 2, the second sheet body 4 and a bearing board 6 (described later), may respectively have a strengthening layer 9 as FIG. 6B shows; for example, a vulcanized paper or a PU protection layer board, used for increasing surface hardness, where the strengthening layer may be formed by attaching a paper board to the surfaces of the first sheet body 2, the second sheet body 4 and the bearing board 6 or spreading hot melt glue thereon. These are exemplary and explanatory only, the present invention is not limited to these. The strengthening layer 9 can increase the surface strength of the first sheet body 2, the second sheet body 4 and the bearing board 6, and prevent them from being damaged due to friction caused by contact with articles 8 (shown in FIG. 7), or the ground.

Figure 7:
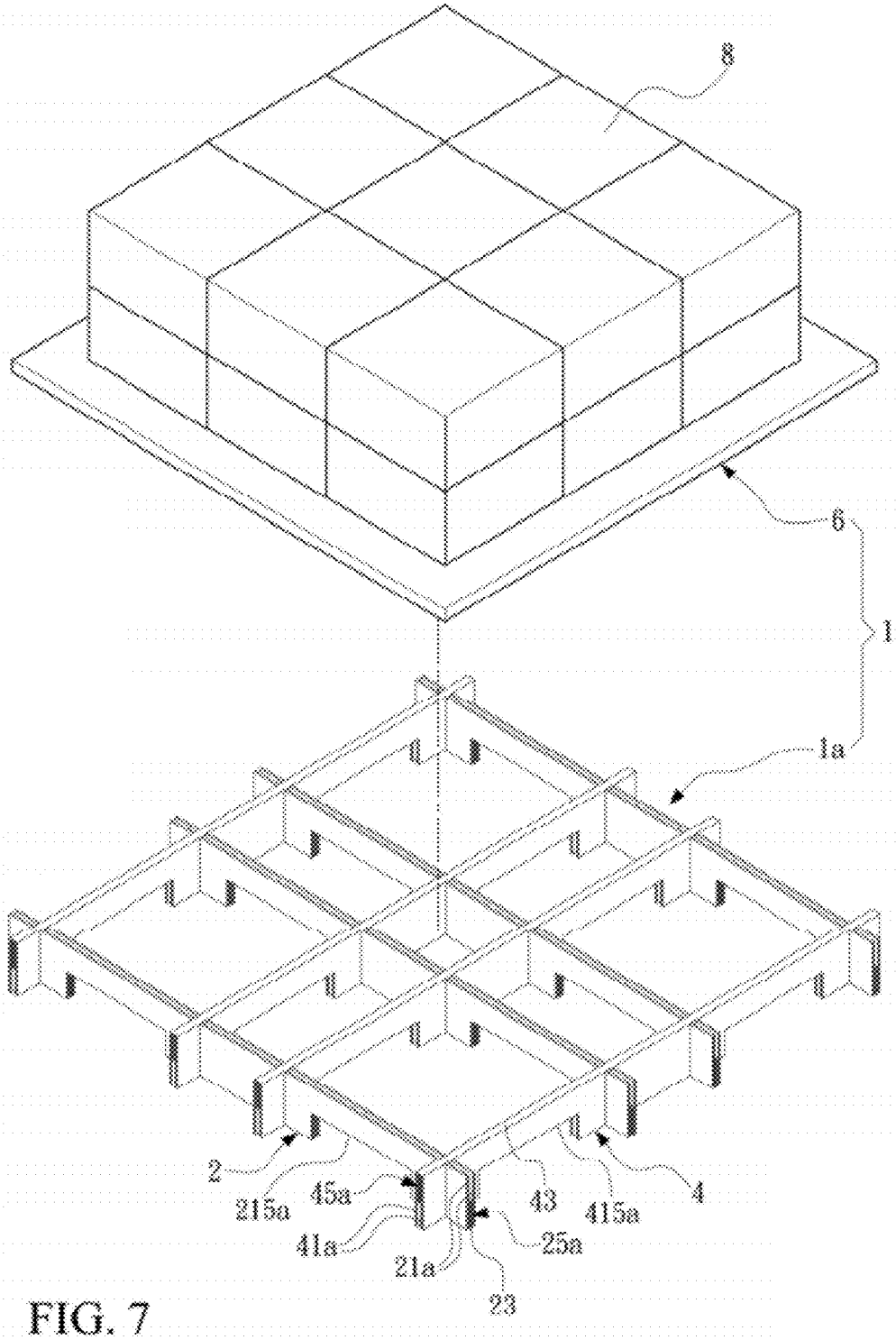
FIG. 7 is a schematically perspective view disclosed by a second preferred embodiment according to the present invention, where a bearing board is included.

Please refer to FIG. 7, which shows a paper pallet structure 1 of a second embodiment according to the present invention. The paper pallet structure 1 of the present embodiment is similar to the one described in the first embodiment, except that it further has the bearing board 6, which may be made from corrugated paper, Kraft paper or recycled paper. However, these are exemplary and explanatory only, the present invention is not limited to these.

The bearing board 6 may be placed on the top side of a bearing base 1*a*, used for carrying the articles contacting with it after the first sheet body 2 and the second sheet body 4 are positioned to perpendicular to each other to form the lattice-typed bearing base 1*a*. In this way, the article 8 will not fall down to the ground through a lattice gap if the size of the article 8 is smaller than the lattice gap of the bearing base 1*a*. Furthermore, the bearing board 6 may be placed on the top of the bearing base 1*a* directly, or the bearing board 6 may be coupled to the bearing base 1*a* by using the glue mentioned in the first embodiment to stick them together.

As mentioned previously, the present invention proposes a paper pallet structure with a simple structure and a good bearing capacity; because the paper pallet structure are only constituted by a plurality of first sheet bodies and a plurality of second sheet bodies, the structure is simple and the manufacturing and the assembly thereof are convenient such that the manufacturing and assembly time and cost can be reduced. Furthermore, the first sheet body and the second sheet body are respectively folded into the shape, the adhesive made from PU or PE is added in proper order and in sequence during the process of folding, allowing the folded sheets to be stiff, for example, allowing the first supporting portion and the second supporting portion to be formed, the first and second supporting portions both have a substantial thickness and after-adhesion strength so that the strength of the paper pallet structure can be increased. Therefore, the paper pallet structure is not easily deformed and damaged by the thrust of an article weight while the paper pallet of the present invention is carrying articles, enabling use of the paper pallet to be effectively extended. In addition, the mass production of the paper pallets of the present invention can be carried out continuously using machines, and the pallets may be transported to a place of use directly after the assembly, or the first sheet bodies and the second sheet bodies manufactured after a mass production are transported to a place of use, and then assembled while they are used, which is simple and convenient.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A paper pallet structure, comprising:

a plurality of first sheet bodies, each first sheet body comprising:

two first outer plate bodies, each first outer plate body comprising a plurality of first slots and a plurality of first fold-lines intersected with each other perpendicularly;

a first connecting portion, positioned between the two first outer plate bodies, and connected respectively to the two first outer plate bodies; and a first inner plate body, connected to one of the two first outer plate bodies, the first inner plate body being folded toward the two first outer plate bodies to form a first supporting portion, the two first outer plate bodies being bent respectively along the plurality of first fold-lines to form two first wing portions, the plurality of first slots being then formed into two first engagement portions, and the first supporting portion being positioned between the two first wing portions and coming into abutting contact with the first connecting portion, the width of the first supporting portion being the distance from the connecting portion to the first engagement portions; and a plurality of second sheet bodies, each second sheet body comprising:

two second outer plate bodies, each second outer plate body comprising a plurality of second slots and a plurality of second fold-lines intersected with each other perpendicularly;

a second connecting portion, positioned between the two second outer plate bodies, and connected respectively to the two second outer plate bodies; and a second inner plate body, connected to one of the two second outer plate bodies, the second inner plate body being folded toward the two second outer plate bodies to form a second supporting portion, the two second outer plate bodies being bent respectively along the plurality of second fold-lines to form two second wing portions, the plurality of second slots being then formed into two second engagement portions, and the second supporting portion being positioned between the two second wing portions and coming into abutting contact with the second connecting portion, and the width of the second supporting portion being the distance from the connecting portion to the second engagement portions, where the first engagement portions are engaged with the second engagement portions to position the two first sheet bodies and the two second sheet bodies perpendicular to each other.

2. The paper pallet structure according to claim 1, wherein folded positions of the two first outer plate bodies and the two second plate bodies are stuck by means of glue.

3. The paper pallet structure according to claim 1, wherein the first outer plate body further comprises a plurality of first through holes adjacent to the first slots and perpendicular to the first fold-lines, the first through holes are formed into a plurality of first retaining grooves after the first outer plate bodies are bent along the first fold-lines.

4. The paper pallet structure according to claim 1, wherein the second outer plate body further comprises a plurality of second through holes adjacent to the second slots and perpendicular to the second fold-lines, the second through holes are formed into a plurality of second retaining grooves after the second outer plate bodies are bent along the second fold-lines.

5. The paper pallet structure according to claim 1, wherein surfaces of the first sheet bodies and the second sheet bodies further respectively comprises a water repellent protection layer.

6. The paper pallet structure according to claim 1, wherein the first sheet body further comprises a plurality of first locking elements, adapted to coupled the first wing portions to the first supporting portion.

7. The paper pallet structure according to claim 1, wherein the second sheet body further comprises a plurality of second locking elements, adapted to coupled the second wing portions to the second supporting portion.

8. The paper pallet structure according to claim 1, wherein the first wing portions and the first supporting portion, or the second wing portions and the second supporting portion are coupled to each other by means of glue.

9. The paper pallet structure according to claim 1, further comprising a bearing board, the bearing board being placed on a top side of a bearing base after the first sheet bodies and the second sheet bodies are positioned perpendicular to each other to form the bearing base.

10. The paper pallet structure according to claim 9, further comprising a strengthening layer, positioned respectively on the first sheet body, the second sheet body and the bearing board to increase surface hardness.

* * * * *